US006155577A

United States Patent [19]

Okajima

[11] Patent Number: 6,155,577

[45] **Date of Patent: *Dec. 5, 2000**

[54] HIGHBACK LEVER MECHANISM

[75] Inventor: Shinpei Okajima, Izumi, Japan

[73] Assignee: Shimano Inc., Sakai, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/133,008

[22] Filed: Aug. 12, 1998

[51] Int. Cl.[7] ..... B62B 9/04

[52] U.S. Cl. ..... 280/14.2; 280/613; 280/618; 36/117.1

[58] Field of Search ..... 280/618, 619, 280/620, 632, 633, 634, 11.36, 14.2, 613, 614, 615, 624; 36/47.1

[56] References Cited

U.S. PATENT DOCUMENTS

| | | | |
|---|---|---|---|
| 3,486,247 | 12/1969 | Franet . | |
| 3,854,743 | 12/1974 | Hansen | 280/618 |
| 3,984,124 | 10/1976 | Gertsch | 280/618 |
| 4,022,492 | 5/1977 | Gertsch | 280/618 |
| 4,188,046 | 2/1980 | Fleckenstein | 280/618 |
| 5,354,088 | 10/1994 | Vetter et al. | 280/633 |
| 5,692,765 | 12/1997 | Laughlin | 280/619 |
| 5,727,797 | 3/1998 | Bowles | 280/14.2 |
| 5,762,358 | 6/1998 | Hale | 280/618 |
| 5,765,853 | 6/1998 | Erb | 280/618 |
| 5,820,139 | 10/1998 | Grindl | 280/618 |
| 5,855,380 | 1/1999 | Di Filippo et al. | 280/613 |

FOREIGN PATENT DOCUMENTS 0 657 115 3/1999 European Pat. Off. .

*Primary Examiner*—J. J. Swann
*Assistant Examiner*—James S. McClellan
*Attorney, Agent, or Firm*—Shinjyu An Intellectual Property Firm

[57] ABSTRACT

The present invention relates to a highback support which is pivotally mounted to a support member. A lever mechanism fixed to a backside of the highback support includes a lever which selectively engages a portion of the support member and provides mechanical advantage for setting and releasing the highback support between a support position and a release position. In the support position, the highback support is positioned to engage the back of a snowboard boot to provide a rigid surface against which a snowboard rider can lean for steering. In the release position, the highback support is free to pivot making it possible for the snowboard rider to walk easily.

8 Claims, 9 Drawing Sheets

HIGHBACK LEVER MECHANISM

BACKGROUND OF THE INVENTION

A. Field Of The Invention

The invention relates to a lever mechanism for a highback boot support, specifically to a lever mechanism which facilitates adjustment of the position of the highback boot support.

B. Description Of The Related Art

Boots that are used for, for instance, skiing and/or snowboarding must have a high degree of rigidity for effecting steering while skiing and snowboarding. In particular, when snowboarding it is important that the rider be able to lean to the side, back and forward with respect to the snowboard. The motion corresponding to the direction of the lean of the rider is transmitted through the boots to the snowboard (or skis) to effect turning or braking. Therefore, it is extremely important that the boots worn by the rider have sufficient rigidity to transfer such leaning motion to the snowboard or skis.

In particular, the back side of a snowboard boot must be rigid in order to provide the appropriate support for controlling movement of the snowboard. Further, as the art of snowboarding has developed, riders have found that snowboard boots provide optimal support when the back side of the snowboard boots are inclined slightly, such that the knees of the rider are always slightly bent when wearing the boots on level ground. Therefore, standing up straight with knees straight when wearing inclined snowboard boots is not always comfortable. Further, walking in such snowboard boots is sometimes awkward.

Recently, snowboard boots have been developed which have allow for a rider to adjust and change the inclination of inclined backside snowboard boots. For example, there are snowboard boots which include a member known as a highback support that is secured to the snowboard boot by pins which allow the highback support to pivot about the pins. The highback support extends up the back side of the boot and when locked into position fixes the back side of the boot into a predetermined inclined position that is optimal for snowboarding. When unlocked, the highback support can pivot back and allow the rider wearing the boot to stand up straight and walk more freely without having to keep the knees bent. A simple bar is used with such a boot for locking the highback support in place. Typically, the bar braces the highback support into position. An upper end of the bar is fixed to an upper portion of the highback support by a pivot pin. A lower end of the bar is configured to fit into a hook formed in a lower portion of the boot. When a rider is wearing the boots, the rider must lean forward in order to fit the bar into and out of position. The lean forward requires a significant amount of effort due to the overall rigidity of the snowboard boots and therefore the bar configuration, especially in the snow and cold, can be difficult for some riders to release and/or engage.

SUMMARY OF THE INVENTION

One object of the present invention is to provide a highback support of a snowboard boot with an adjustment mechanism that is easy to manipulate.

Another object of the present invention is to provide a highback support for a snowboard boot with a reliable means of adjusting the lean of the highback support.

In accordance with one aspect of the present invention, a lever mechanism for a highback boot support includes a support member and a highback support pivotally mounted to the support member via first pivot pins. The highback support is configured for supporting the back side of an article of footwear. The highback support is pivotal between a support position and a release position. A bracket is fixed to the highback support and a link mounted to the bracket via a second pivot pin. A lever member is mounted to the link via a third pivot pin. The support member is formed with a receiving portion for receiving a portion of the lever member such that with the lever member engaged with the receiving portion, the highback support is restrained in the support position against pivotal movement in one direction.

Preferably, the support member is configured to be permanently fixed to a portion of a snowboard boot.

Preferably, the first pivot pins extend through upper portions of the support member and are positioned just below opposite sides of an ankle supporting portion of the snowboard boot.

Preferably, the lever mechanism further includes a pair of straps fixed to the first pivot pins. The pair of straps are configured to wrap around a lacing portion of the snowboard boot Alternatively, the support member includes a means for fixing the support member to a snowboard.

Preferably, the means for fixing the support member to a snowboard includes a plate configured for attachment to the snowboard. A portion of the support member extends at least partially under the plate. The plate is configured to confine the support member against the snowboard.

Preferably, the support member includes fastening members for engaging a portion of a snowboard boot for securing the snowboard boot the support member.

Preferably, the first pivot pins extend through upper portions of the support member and the first pivot pins are positioned below opposite sides of an ankle supporting portion of the snowboard boot.

These and other objects, features, aspects and advantages of the present invention will become more fully apparent from the following detailed description of the present invention when taken in conjunction with the accompanying drawings where like reference numerals denote corresponding parts throughout the various drawings.

DETAILED DESCRIPTION OF THE PREFERRED EMBODIMENTS

Figure 1:
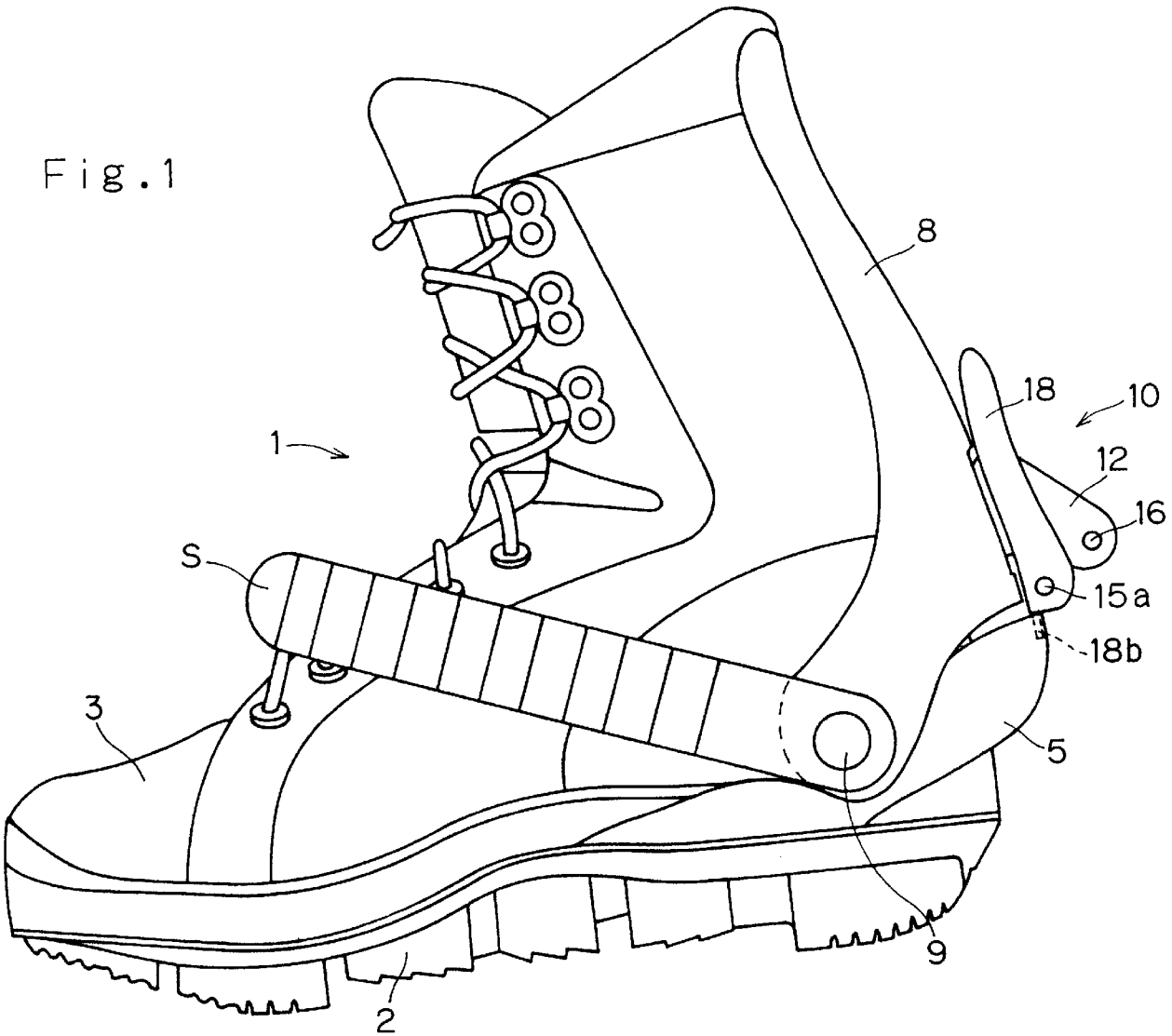
FIG. 1 is a side view of a snowboard boot which has a highback support member in accordance with a first embodiment of the present invention, with the highback support in a support position.

A first embodiment of the present invention is depicted in FIGS. 1, 2, 3 and 4. A boot 1 is generally configured for use in snowboarding. The boot 1 is formed with a sole 2 and an upper portion 3 that are fixed to one another. Typically, the sole 2 is made from a stiff rubber-like material and, in the embodiment depicted, includes an engagement member (not shown) which is configured for engagement with a fastening mechanism (not shown) disposed on a snowboard (not shown). The fastening mechanism is of a type known as a CLICKER™ mechanism manufactured by Shimano Inc., Osaka, Japan. Generally, the upper portion 3 may be made of any of a variety of materials such as plastic materials, leather and/or synthetic leather materials.

A support member 5 is fixed to the sole 2. The support member 5 has an arcuate shape such that the support member 5 extends around the back side of the boot 1 and attaches to the sides of the sole 2. A highback support 8 is fixed to the support member 5 via pins 9. The pins 9 allow the highback support to pivot freely on the support member 5. The pins 9 are located on opposite sides of the boot 1, just below an ankle supporting portion of the boot 1 which supports an ankle of a foot.

Straps S are fixed to the pins 9 (only one strap is visible in the drawings). The straps S are configured to wrap around the lace portion of the boot 1 to provide a firmer engagement between the boot 1 and the foot within the boot 1.

A lever mechanism 10 is fixed to the highback support 8. The lever mechanism 10 includes a bracket 12 that is rigidly fixed to the highback support 8. As is more easily seen in FIG. 4, the bracket 12 is formed with a channel 12*a* which is centrally located in the bracket 12. Thus, the channel 12*a* defines to side portions 12*b* and 12*c* of the bracket 12. The lever mechanism 10 also includes a T-shaped link 15. As shown in FIG. 3, the T-shaped link 15 is upside-down with respect to the T-shape, with one end of the T-shaped link 15 being connected to the bracket 12. A pin 16 (FIGS. 1 and 2) extends between the side portions 12*b* and 12*c* of the bracket 12 and further extends through one end of the T-shaped link 15. The T-shaped link 15 is therefore free to pivot about the pin 16.

A lever 18 is connected to the T-shaped link 15 via a pin 15*a*. The pin 15*a* extends through the T-shaped link 15 and through portions of the lever 18 as shown in FIGS. 1, 2, 3 and 4. Therefore, the lever 18 is free to pivot about the pin 15*a* on the end of the T-shaped link 15. The lever 18 is formed with a central opening 18*a* through which the bracket 12 extends. The lower end of the lever 18 is formed with a tongue 18*b*. The tongue 18*b* is configured to extend between a back side of the upper portion 3 and the support member 5, as is depicted in FIG. 1.

The first embodiment of the present invention operates as follows. The boot 1 may be attached to a snowboard (not shown) via the engagement member (not shown) and CLICKER™ mechanism. When riding a snowboard, it is desirable to have support from the highback support 8 to facilitate responsive steering and control of the snowboard. Therefore, while snowboarding, the lever mechanism 10 is preferably in the support position as depicted in FIG. 1. In order to walk more easily in the boot 1, the highback support 8 must be moved to the released position depicted in FIG. 3. In order to release the lever mechanism 10 and hence free the highback support 8 so it may pivot back about the pin 9, the upper end of the lever 18 must be pulled away from the adjacent portion of the boot 1, as indicated by the arrow A in FIG. 2. As can be seen by the position of the lever 18 in FIG. 2, the lever 18 may be pulled back away from the boot 1. However, the lever 18 does not pull back completely freely. The relative dimensions of the bracket 12, the T-shaped link 15 and the lever 18 are such that the bottom of the lever 18 is forced against the support member 5 in order to pivot the lever 18 into the position depicted in FIG. 2. In other words, the it requires a predetermined amount of force to move the lever 18 away from the boot 1.

Figure 2:
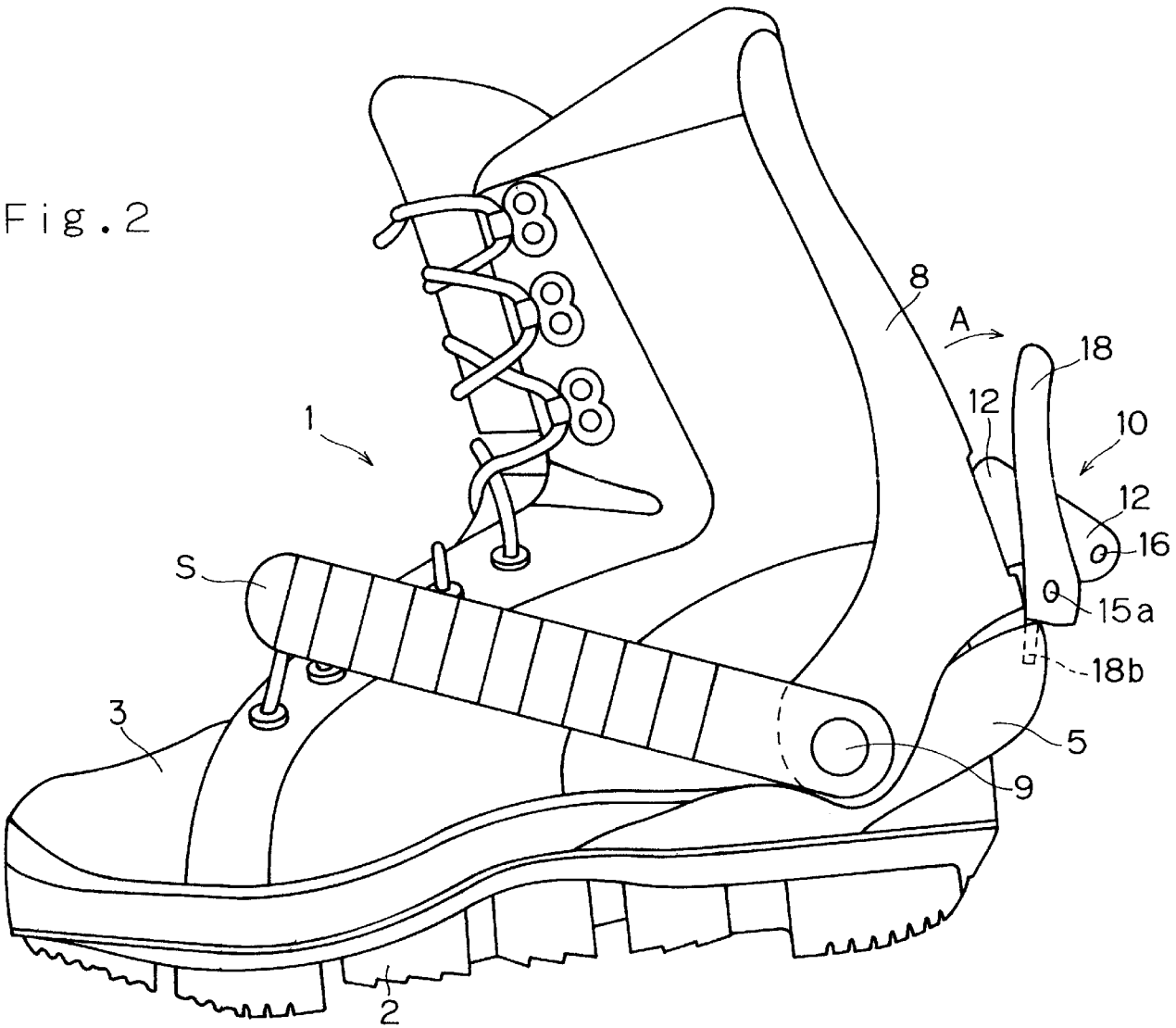
FIG. 2 is a side view of the snowboard boot similar to FIG. 1, but showing a lever mechanism of the highback support member partially moved to release the highback support member out of the support position to a released position.
Figure 3:
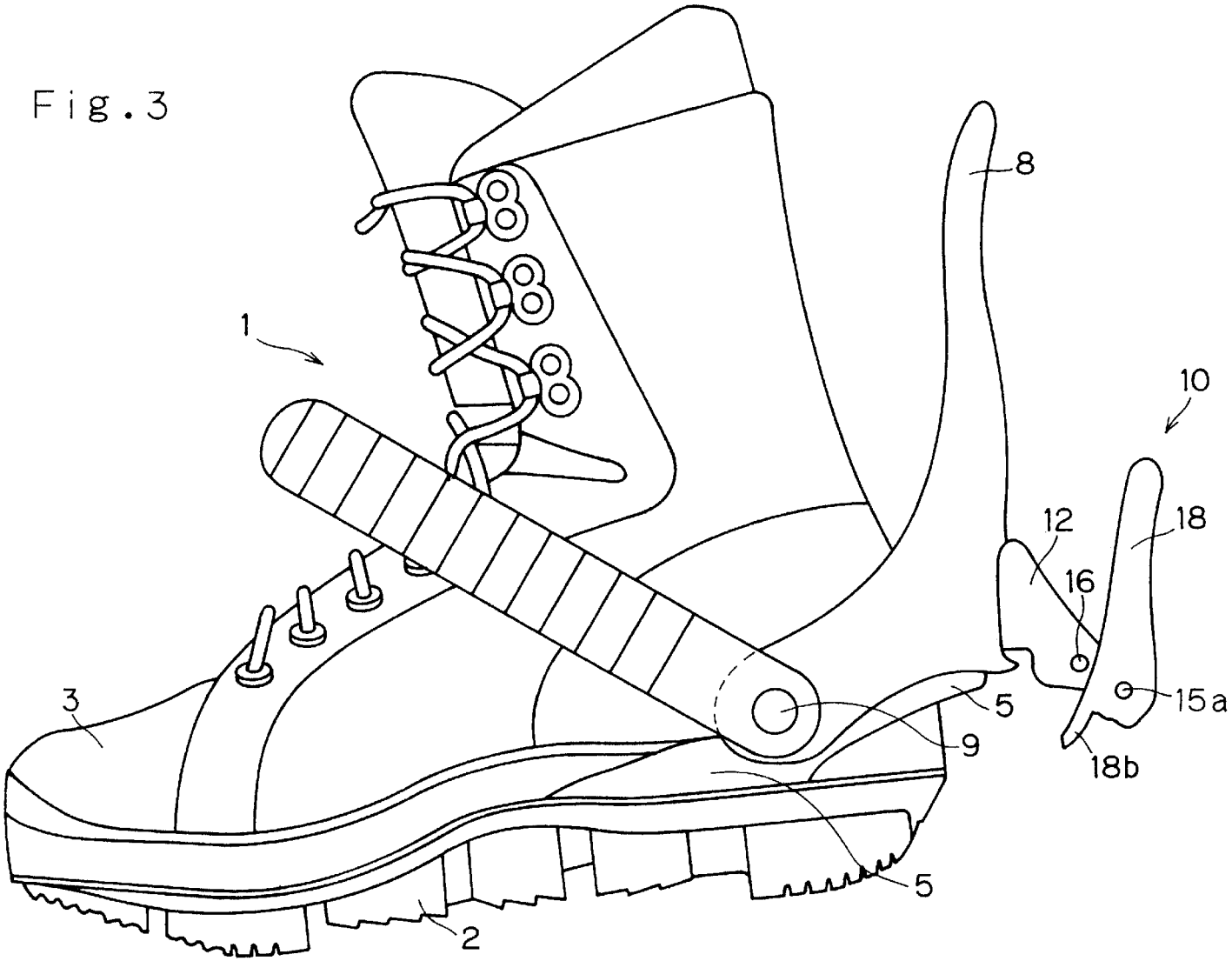
FIG. 3 is a side view of the snowboard boot, similar to FIGS. 1 and 2, but showing the highback support in the released position for walking.
Figure 4:
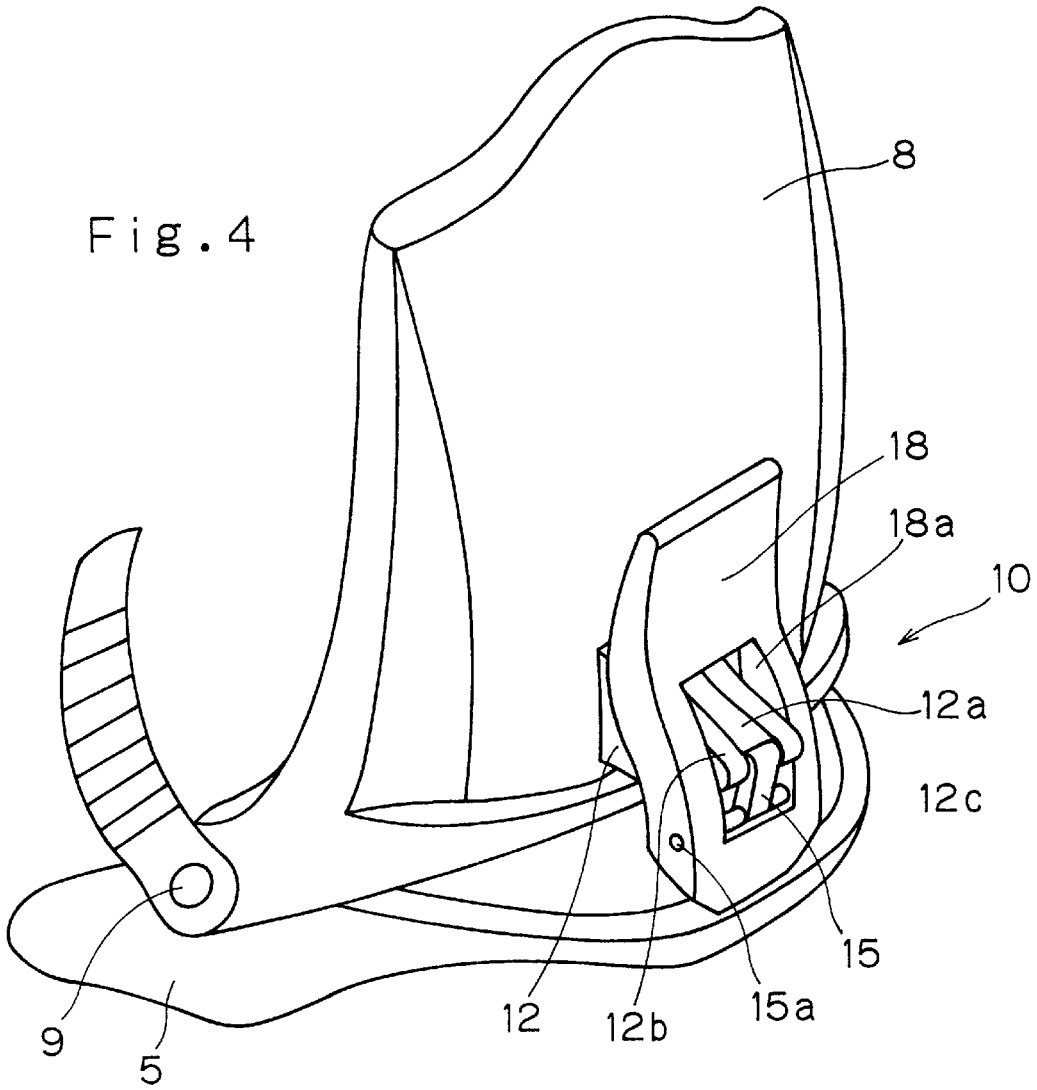
FIG. 4 is perspective, rear view of the highback support member and supporting structure with the boot removed in order to show details of the highback support and supporting structure.

As the lever 18 moves from the position depicted in FIG. 1 to the position depicted in FIG. 2, the lever 18 pivots about the pin 15*a*. Since the pin 15*a* extend through the T-shaped link 15, and the T-shaped link 15 is connected to the bracket 12, the T-shaped link 15 pivots slightly about the pin 16 as the lever 18 moves to the position in FIG. 2. The force produced by the movement of the lever 18 is amplified by the movement of the T-shaped link 15 thus urging the lever 18 downward against the support member 5. The force acts as a means for biasing the lever 18 into the position depicted in FIG. 1.

If the movement of the lever 18 indicated by the arrow A in FIG. 2 continues, the T-shaped link 15 pivots about the pin 16 to a point where the tongue 18*b* may be pulled out from between the support member 5 and the rear end of the boot 1, as is shown in FIG. 3. Further, as is shown in FIG. 3, when the lever mechanism is released, the highback support 8 may pivot about the pins 9 and move to a position that makes walking in the boots easier.

In order to put the highback support 8 into a position which provides support for snowboarding, the rider wearing the boot 1 must lean slightly forward and the highback support 8 moved from the released position depicted in FIG. 3 toward the support position depicted in FIGS. 1 and 2. Next, the lever 18 is lifted until the tongue 18*b* can be inserted in the space defined between the back of the boot 1 and the support member 5. Since the lever 18 and the T-shaped link 15 are both free to pivot with respect to each other and the bracket 12, inserting the tongue 18*a* is almost effortless with the upper end of the lever 18 being spaced apart from the boot 1. Next, the rider must push the upper end of the lever 18 toward the boot 1 in a direction opposite the direction of the arrow A in FIG. 2. The lever 18 once in the position depicted in FIG. 2, will gently snap into the position depicted in FIG. 1, thus locking the highback support 8 into the support position. Since the lower end of the lever 18 is constrained by the tongue 18*a* being engaged with the support member 5, and the lever 18 is biased into the position depicted in FIG. 1 movement of the highback support 8 is not possible.

Figure 5:
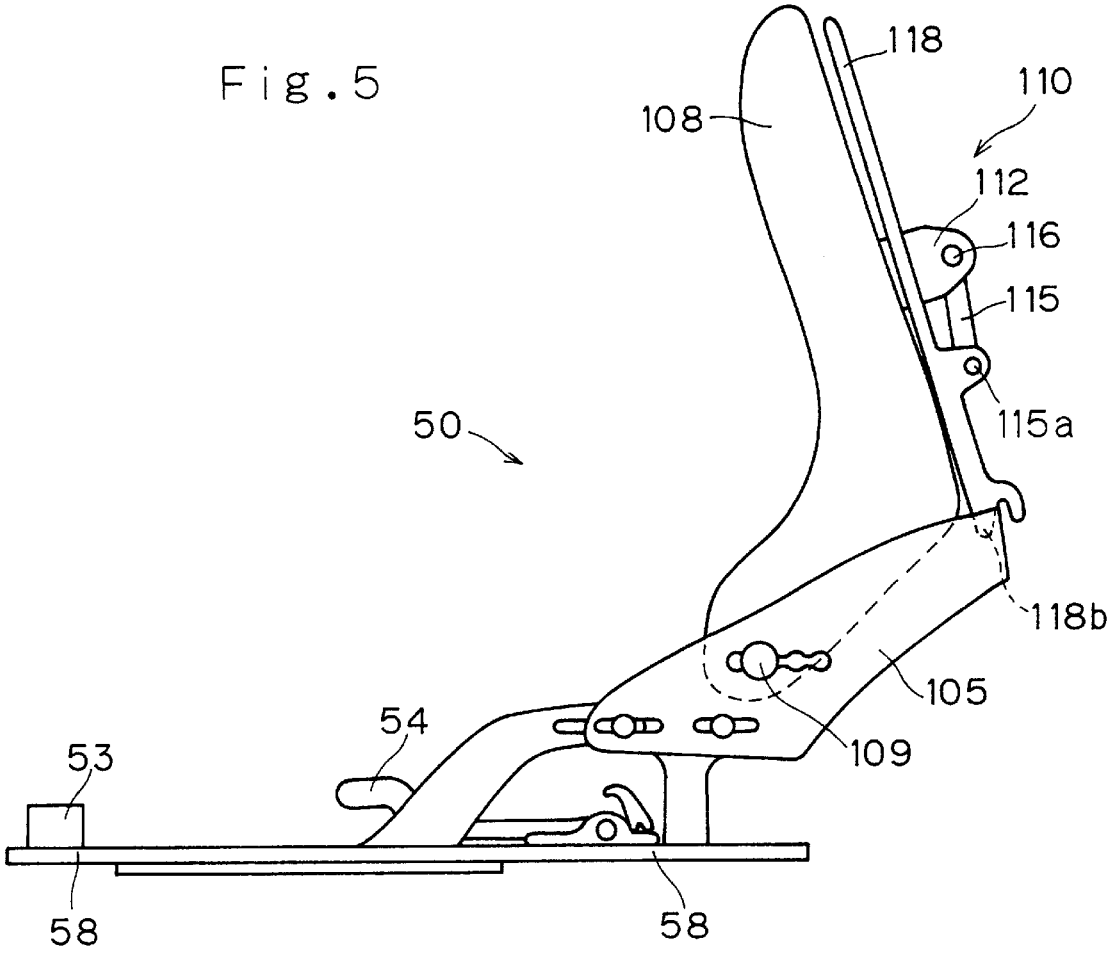
FIG. 5 is a side view of a boot support structure having a highback support member in accordance with a second embodiment of the present invention, with the highback support in a support position.
Figure 6:
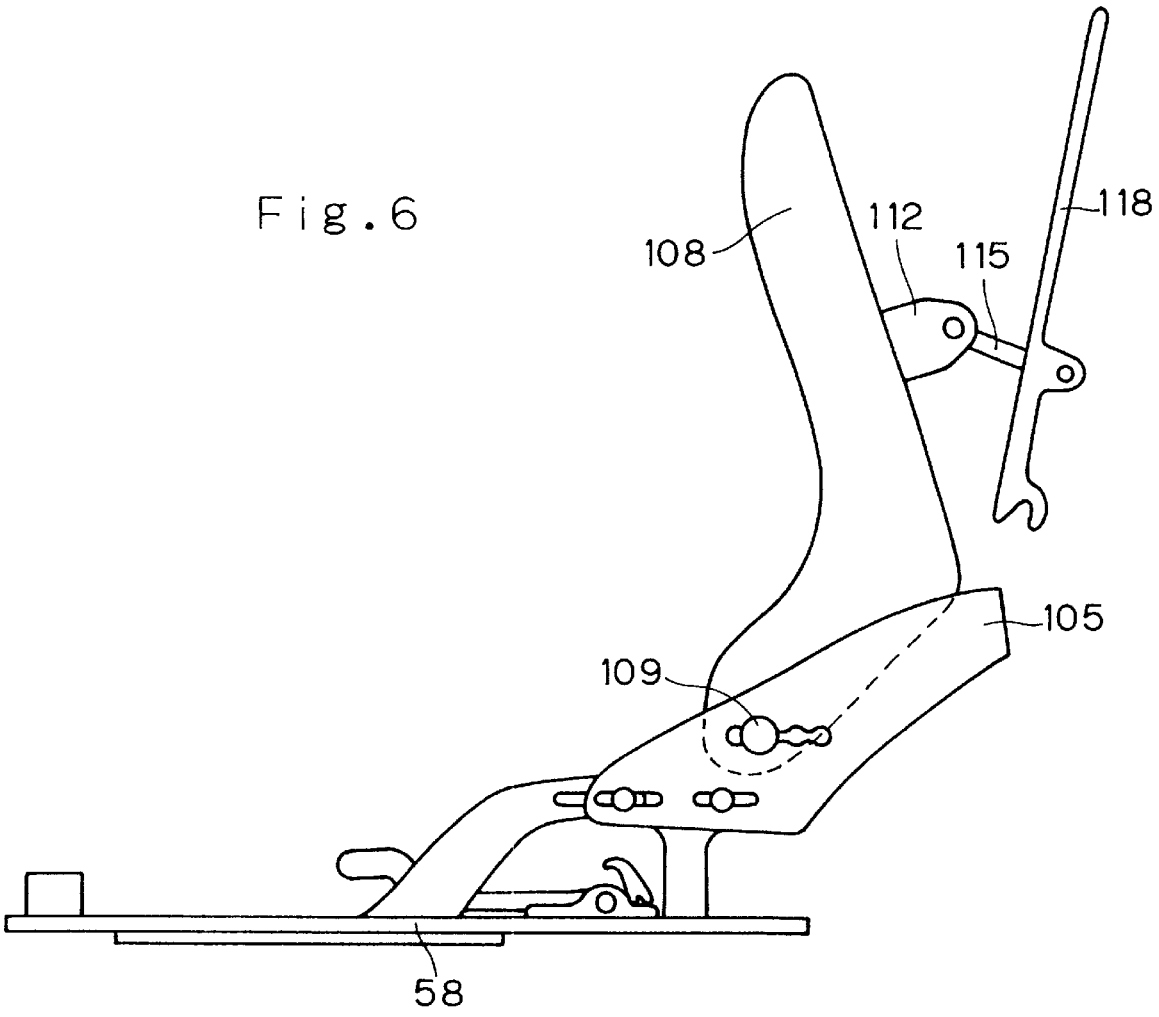
FIG. 6 is a side view of the boot support structure, similar to FIG. 5, but showing the highback support in a released position for walking.
Figure 7:
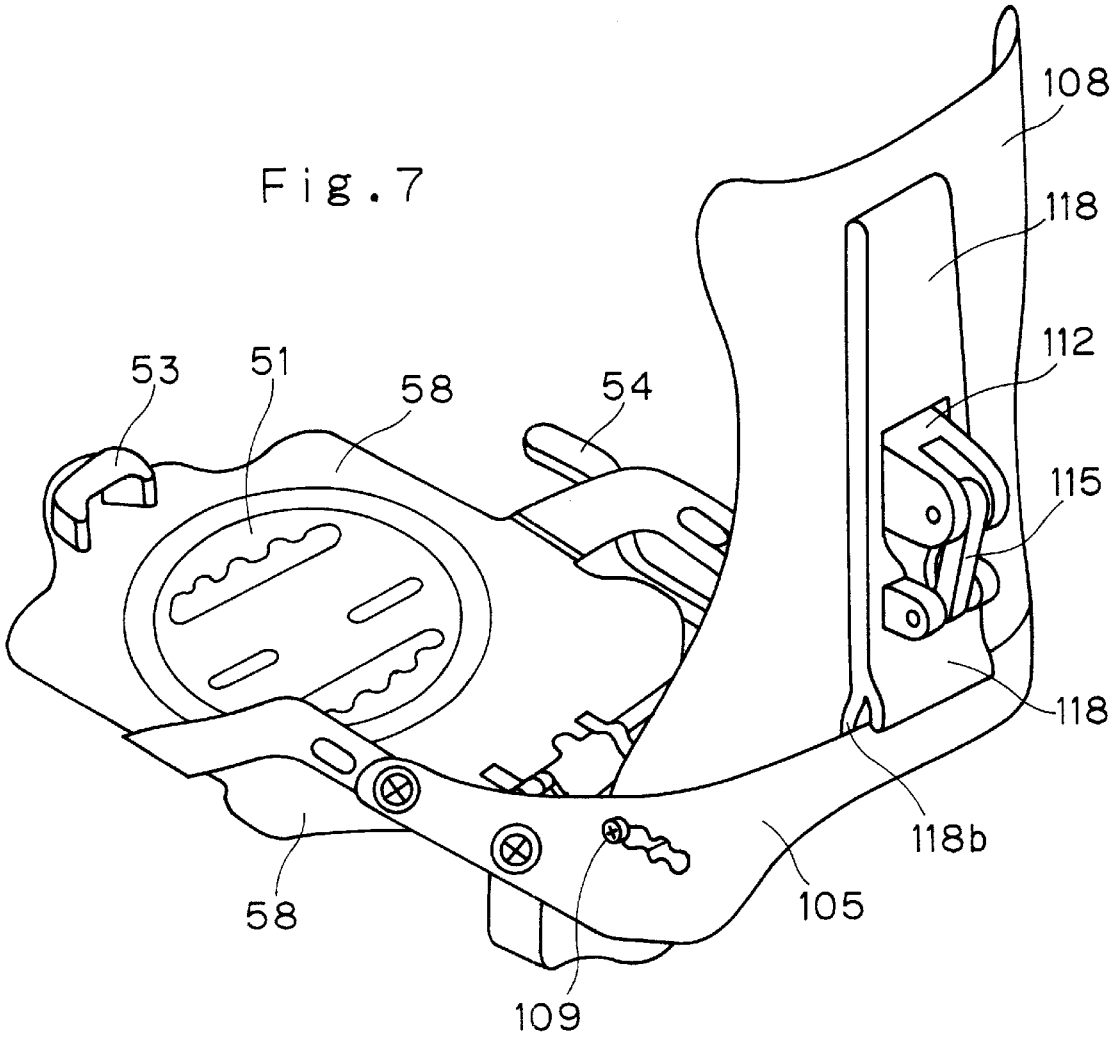
FIG. 7 is perspective, rear view of the boot support structure showing details of the highback support member and supporting structure.

The present invention may be applied to boot support structures such as the boot support structure 50 depicted in FIGS. 5, 6, and 7. The boot support structure 50 depicted in FIGS. 5, 6 and 7 is in accordance with a second embodiment of the present invention. Many snowboard riders do not have snowboard boots that include highback supports but desire such support. The boot support structure 50 provides such support and provides a means for releasing the highback support in a manner similar to that described above with respect to the first embodiment.

In the second embodiment, the boot support structure 50 includes a plate 51 which may be fixed to a snowboard (not shown). The plate 51 includes bolt holes which facilitate attachment to snowboards. A fastening mechanism having a clip 53 and lever release 54, such as Shimano's CLICKER™ mechanism may be incorporated into the boot support structure 50. However, it should be understood that the present invention may also apply to a boot support structure that does not include Shimano's CLICKER™ mechanism.

The plate 51 engages a base 58 and partially extend through an opening (not shown) in the base 58 such that, when the plate 51 is bolted to a snowboard, the base 58 is rigidly held against the snowboard. A support member 105 is fixed to the base 58 via bolts. A highback support 108 is fixed to the support member 105 via pins 109 and may pivot about the pins 109. A lever mechanism 110 is fixed to the back side of the highback support 108. The lever mechanism 110 includes a bracket 112 that is fixed to the back side of the highback support 108. A link 115 is connected to the bracket 112 via a pin 116. The link 115 is also fixed to a lever 118 via a pin 115*a*. The lever 118 is formed at a lower end thereof with a tongue 118*b*.

The lever mechanism 110 functions in generally the same manner as the lever mechanism 10 described above with respect to the first embodiment and therefore a functional description will not be duplicated.

It should be understood that in the second embodiment, the lever 118 is much longer that the lever 18 described above with respect to the first embodiment. The relative length is not considered to be important to understanding the present invention. Rather, the lever mechanism 110 of the second embodiment is generally functionally equivalent to the lever mechanism 10 in the first embodiment and differs in aesthetic appearance. However, the lever 118 of the second embodiment being longer than the lever 18 of the first embodiment does provide a mechanical advantage that may assist in operating same. Therefore, it should also be understood that the lever 118 and the lever 18 are interchangeable between the first and second embodiments depending on the needs of the rider who uses the present invention.

Figure 8:
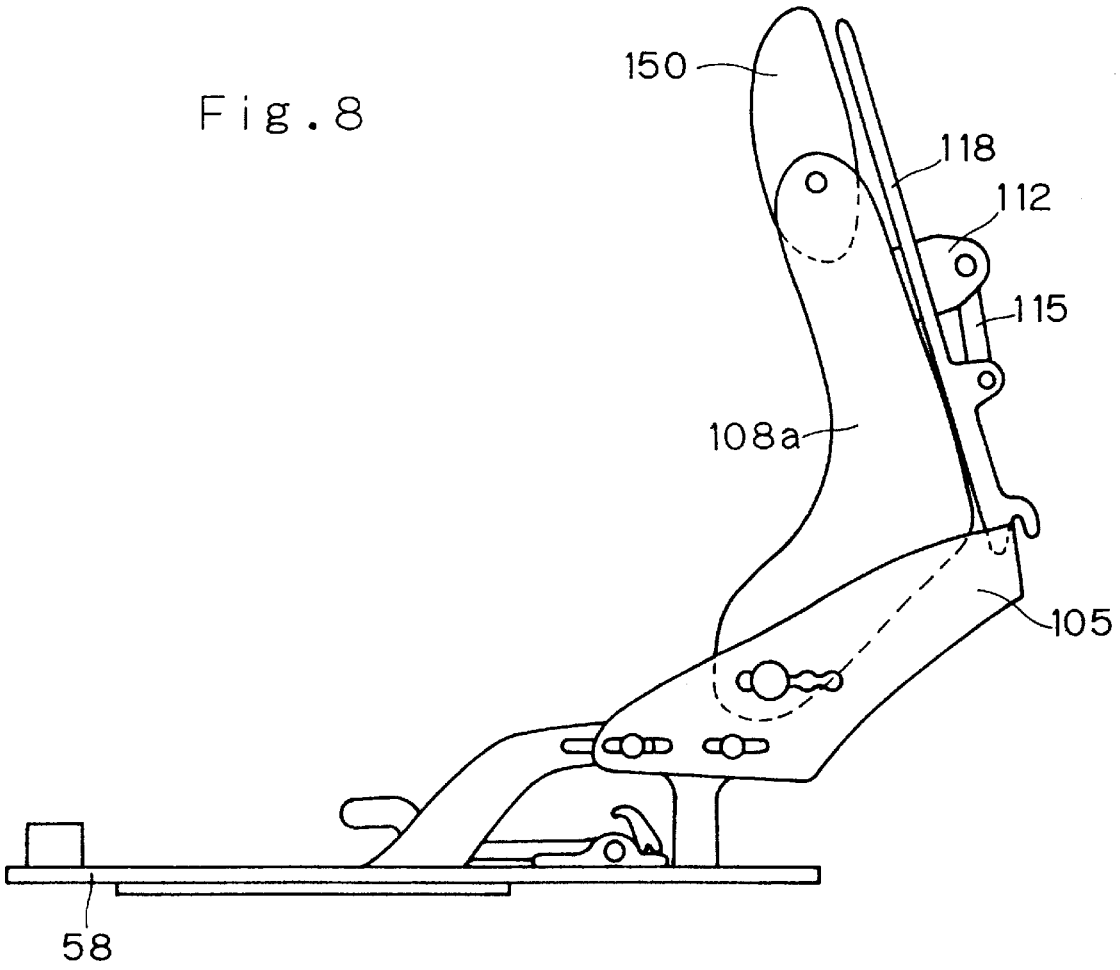
FIG. 8 is a side view of a boot support structure, similar to FIGS. 5 and 6, showing a third embodiment of the present invention where a highback support member is further provided with a pivoting upper support member.
Figure 10:
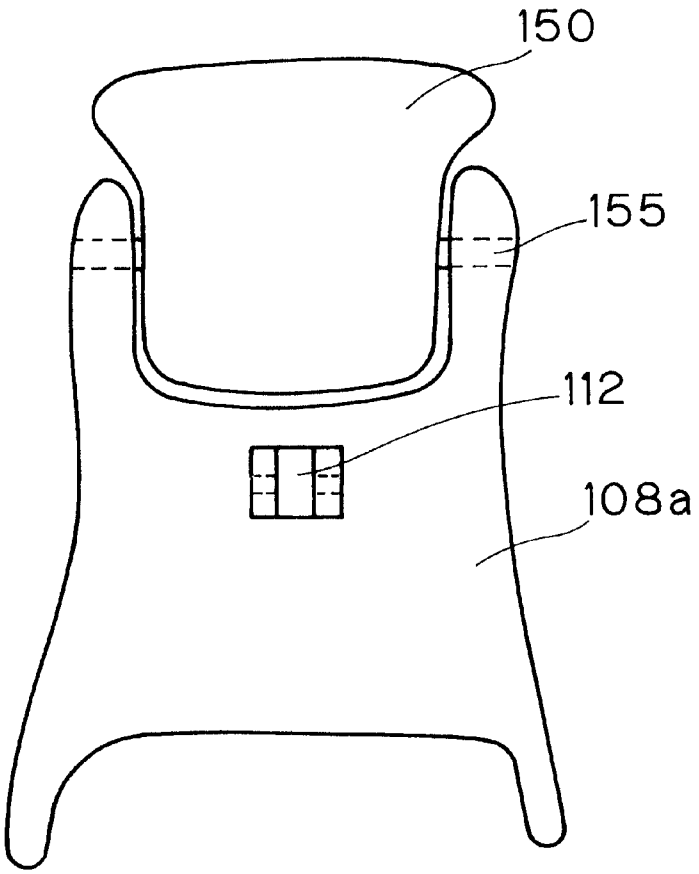
FIG. 10 is a backside or end view of the highback support member depicted in FIG. 8.
Figure 9:
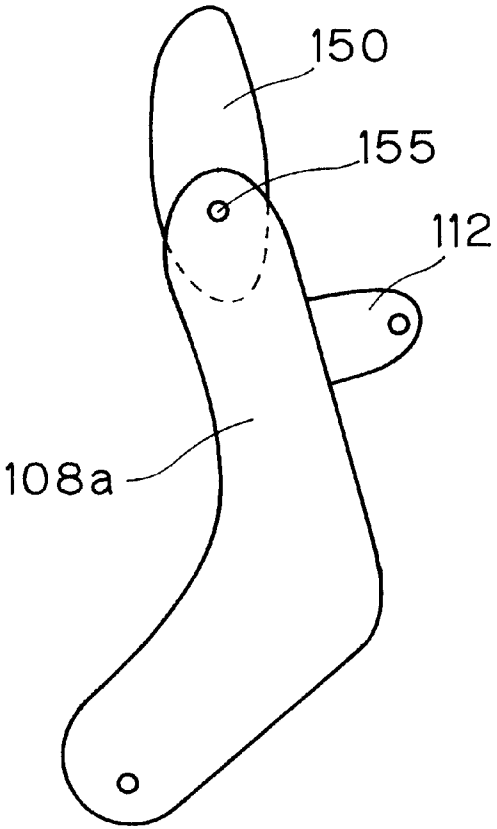
FIG. 9 is a side view of the highback support member depicted in FIG. 8 shown removed from the boot support structure.

In accordance with a third embodiment of the present invention depicted in FIGS. 8, 9 and 10, the highback support 108 may be modified slightly. A highback support 108*a* is depicted in FIGS. 8, 9 and 10. The highback support 108*a* is not as tall as the highback support 108 in the second embodiment. The highback support 108*a* instead includes an upper support member 150. The upper support member 150 is connected to the highback support 108*a* via pins 155. The upper support member 150 is generally free to pivot about the pins 155. The upper support member 150 provides firm inclined support for the lower part of a riders leg but pivots to accommodate the various size and shapes of the lower leg of various individuals.

It should be understood that the upper support member 150 could also be installed on the highback support 8 in the first embodiment and is not limited to use with the highback support 108*a* in the third embodiment. Indeed the highback support 108*a* could replace the highback support 8 of the first embodiment simple substitution thereof.

By the various embodiments of the present invention, it is possible to provide either a boot or a boot support structure with easy and reliable means for switching between a condition with provides rigid back support and a condition where walking in snowboard boots or standing up straight in snowboard is simple and easily effected. Such means for switching conditions makes it possible to easily adjust boots to accommodate various individuals in a single style of boot or boot support structure. For example, a person with a large calf muscle and a person with a generally small calf muscle may fit into the same type of boot or boot support structure.

The various embodiments of the lever mechanism described above allow for selective positioning of the highback support between a support position and a release position. In the support position, the highback support is positioned to engage the back of the snowboard boot to provide a rigid surface against which a snowboard rider can lean for steering. In the release position, the highback support is free to pivot making it possible for the snowboard rider to walk easily. The lever mechanism also provides a mechanical advantage making it easier for the rider to fix and release the highback support in the support position.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A snowboard boot having a lever mechanism for a highback boot support, the snowboard boot and lever mechanism comprising:

a support mcmber fixed to a lower portion of said snowboard boot, said support member having an arcuate shape extending around a heel portion of said snowboard boot, said support member being formed with a receiving portion proximate a mid-portion of said support member at a back side of said snowboard boot, said receiving portions being spaced apart from the back side of snowboard boot;

a highback support pivotally mounted to said support member via first pivot pins, said highback support being configured for supporting the back side of said snowboard boot, said highback support being pivotal between a support position and a release position;

a bracket fixed to said highback support;

a link mounted to said bracket via a second pivot pin, said link being pivotal about said second pivot pin;

a lever member mounted to said link via a third pivot pin, said lever member being pivotal about said third pin and being further free to pivot with said link about said second pivot pin, a lower end of said lever member being formed with a tongue which extends downward from said lever member, said tongue being configured for selective engagement with said receiving portion, and wherein, with said tongue member engaged with said receiving portion, said lever member is pivotal about said second pivot pin such that said third pivot pin is positionable under said second pivot pin and under a portion of said bracket thereby providing leverage to urge said bracket upward and urge said highback support into said support position against pivotal movement in one direction.

2. The snowboard boot as set forth in claim 1, wherein said first pivot pins extend through upper portions of said support member, said first pivot pins being positioned below opposite sides of an ankle supporting portion of the snowboard boot.

3. The snowboard boot as set forth in claim 2, further comprising at least one strap fixed to one of said first pivot pins, said strap being configured to wrap around a lacing portion of the snowboard boot.

4. A support mechanism for supporting a snowboard boot on a snowboard, the support mechanism having a lever mnechanism for a highback boot support, the support mcchanism and lever mechanism comprising:

a base configured for attachment to the snowboard, a support member fixed to said base, said support member having an arcuate shape configured to extend around a back portion of the snowboard boot, said support member being formed with a receiving portion proximate a mid-portion of said support member proximate a heel portion of the snowboard boot, said receiving portions being spaced apart from the heel portion of the snowboard boot;

a highback support pivotally mounted to said support member via first pivot pins, said highback support bring configured for supporting the back side of the snowboard boot, said higliback support being pivotal between a support position and a release position;

a bracket fixed to said highback support;

a link mounted to said bracket via a second pivot pin;

a lever member mounted to said link via a third pivot pin, said lever member being pivotal about said third pin and being further free to pivot with said link about said second pivot pin, a lower end of said lever member being formed with a tongue which extends downward from said lever member, said tongue being configured for selective engagement with said receiving portion; and wherein, with said tongue member engaged with said receiving portion, said lever member is pivotal about said second pivot pin such that said third pivot pin is positionable under said second pivot pin and under a portion of said bracket thereby providing leverage to urge said bracket upward and urge said highbacrk support into said support position against pivotal movement in one direction.

5. The support mechanism as set forth in claim 4, wherein said means for fixing said support member to a snowboard comprises a plate configured for attachment to the snowboard, a portion of said support member extending at least partially under said plate, said plate being configured to confine said support member against the snowboard.

6. The support mechanism as set forth in claim 4, wherein said support member includes fastening members for engaging a portion of a snowboard boot for securing the snowboard boot said support member.

7. The support mechanism as set forth in claim 5, wherein said first pivot pins extend through upper portions of said support member, said first pivot pins being positioned below opposite sides of an ankle supporting portion of the snowboard boot.

8. The support mechanism as set forth in claim 4, wherein said highback support includes an upper support member pivotally mounted to an upper portion of said highback support, said upper support member configured for engagement with a lower leg of a snowboard rider.

* * * * *